United States Patent [19]

Hartings

[11] Patent Number: 4,890,115

[45] Date of Patent: Dec. 26, 1989

[54] MAGNETIC ANTENNA

[75] Inventor: Michael F. Hartings, West Carrollton, Ohio

[73] Assignee: Monarch Marking Systems, Inc., Dayton, Ohio

[21] Appl. No.: 154,655

[22] Filed: Feb. 10, 1988

[51] Int. Cl.[4] ..... H01Q 7/04

[52] U.S. Cl. ..... 343/742; 343/841

[58] Field of Search ..... 343/842, 866, 867, 741, 343/742, 841, 870, 788, 728; 340/551, 552, 561, 572

[56] References Cited

U.S. PATENT DOCUMENTS

| | | | |
|---|---|---|---|
| 2,419,480 | 4/1947 | Bryan et al. | 343/842 |
| 2,442,310 | 5/1948 | Polydoroff | 343/842 |
| 4,633,250 | 12/1986 | Anderson et al. | 343/742 |

FOREIGN PATENT DOCUMENTS

| | | | |
|---|---|---|---|
| 1085704 | 10/1967 | United Kingdom | 340/572 |
| 1485219 | 9/1977 | United Kingdom | 343/742 |

*Primary Examiner*—Rolf Hille
*Assistant Examiner*—Michael C. Wimer
*Attorney, Agent, or Firm*—Mason, Kolehmainen, Rathburn & Wyss

[57] ABSTRACT

A magnetic antenna particularly usable for deactivating electronic article surveillance tags that are attached to articles of merchandise to prevent unauthorized removal from a protected area. The antenna comprises a driven element in the form of a transmitting loop, preferably a pair of loops driven in opposite phase, and shield grids disposed on opposite sides of the driven elements. The shield grids serve to prevent electric field radiation from the driven element from propagating past the shield, but permit the passage of magnetic field radiation therethrough. The antenna may also be used at a protected exit to detect the presence of a tag.

10 Claims, 1 Drawing Sheet

Fig. 1
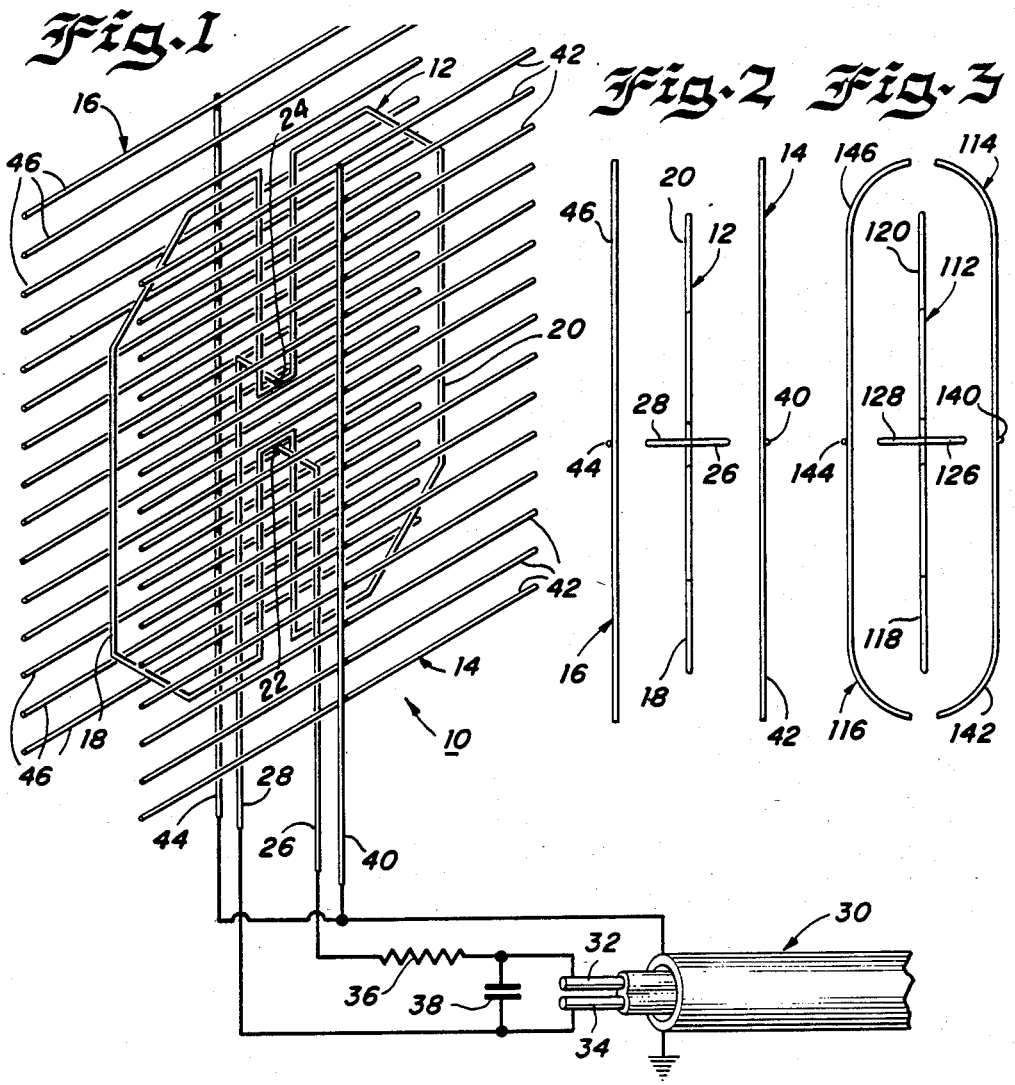
Fig. 2 Fig. 3
Fig. 4
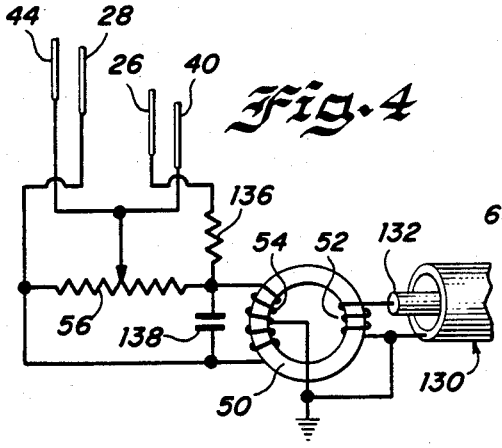
Fig. 5
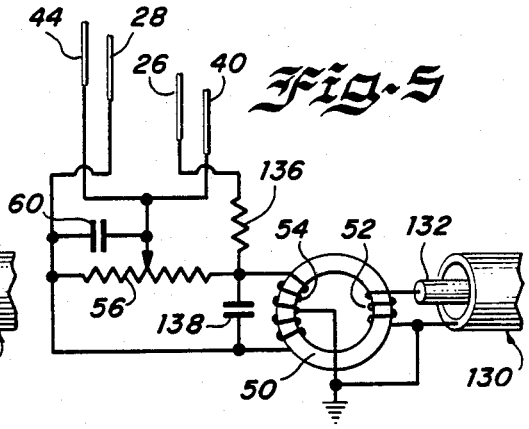

MAGNETIC ANTENNA

BACKGROUND OF THE INVENTION

1. Field of the Invention

This invention relates generally to magnetic field antennas, and more particularly to a magnetic field antenna particularly suitable for use in a device for deactivating or interrogating electronic article surveillance tags. Electronic article surveillance tags are produced in a variety of configurations and employ various operating principles, but all contain a device whose presence can be detected by detection circuitry located at an exit from the protected area. Some types of electronic article surveillance tags cannot be deactivated and must be removed from the article being protected at the point of sale, but others may be deactivated through the application of an intense magnetic radiation field designed to open circuit, for example, by burning out a fusible link, short out, for example, by melting a portion of the tag, or otherwise disable the tag. The antenna according to the invention is particularly suitable in a deactivating station for deactivating such tags, and may also be used at protected exits to interrogate and detect the presence of tags.

2. Prior Art

Various antennas particularly useful for deactivating EAS tags have been proposed, but most have various drawbacks such as excessive bulk, excessive cost or excessive radiation outside of the deactivation station.

SUMMARY OF THE INVENTION

It is an object of the present invention to provide a magnetic field antenna that overcomes many of the disadvantages of the prior art antennas.

It is yet another object of the present invention to provide a magnetic field antenna particularly suitable for the deactivation of electronic article surveillance tags.

It is another object of the present invention to provide a simple, low cost magnetic antenna usable for deactivating or detecting electronic article surveillance tags.

In accordance with a preferred embodiment of the invention, there is provided an active element, preferably in the form of a pair of driven loops that are driven in opposite phase by a deactivation transmitter. Disposed on opposite sides of the active element are a pair of shields disposed in a generally coplanar relationship on opposite sides of the active element. The shields are connected to a source of common potential, for example, ground and serve to permit magnetic radiation to pass therethrough while confining electric field radiation therebetween. The active element and the shields are fabricated from wire or other conductive elements, and the shields extend beyond the periphery of the active element to minimize radiation from the ends of the active element. The shields may also be formed so that the ends thereof turn toward the active element thereby more completely surrounding the active element and reducing radiation from the ends of the active element. Alternatively, the shields may take the form of printed circuit shields.

DESCRIPTION OF THE DRAWINGS

These and other objects and advantages of the present invention will become readily apparent upon consideration of the following detailed description and attached drawing wherein:

FIG. 1 is a perspective view of the antenna according to the present invention, and includes a schematic diagram of a network suitable for coupling the antenna to a source of drive energy;

FIG. 2 is a top view of the antenna according to the invention;

FIG. 3 is a top view of an alternative embodiment of the antenna according to the invention; and FIGS. 4 and 5 are schematic diagrams showing alternative networks suitable for coupling the antenna according to the invention to a drive source.

DETAILED DESCRIPTION

Referring now to the drawing, with particular attention to FIG. 1, there is shown an embodiment of the antenna according to the invention generally designated by the reference numeral 10. The antenna 10 comprises an active element 12 and a pair of gridded shields 14 and 16. Preferably, the active element 12 comprises a pair of loops 18 and 20. The loops 18 and 20 are connected to a pair of feed points 22 and 24 by a pair of conductors 26 and 28. The conductors 26 and 28 are connected to a source of radio frequency energy via a coaxial cable 30 having a pair of central conductors 32 and 34 via a matching network comprising a resistor 36 and a capacitor 38. This arrangement causes the currents circulating in the loops 18 and 20 to circulate in opposite directions, for example, when the current is flowing clockwise in the loop defined by the conductor 18, counterclockwise flow occurs in the loop defined by the conductor 20 and vice versa.

The reason for utilizing two oppositely phased loops in the active element 12 is because of the intended application. The antenna 10 has been designed to deactivate (or detect) EAS tags, and during the deactivation (or detection) process, the tags are in close proximity to the antenna. More particularly, during deactivation (or detection), the tags are generally located within the area encircled by a single one of the conductors 18 and 20, and consequently only a single one of the loops defined by the conductors 18 and 20 has an appreciable effect on the tag. Thus, the field produced by only a single one of the loops operates to deactivate (or detect) the tag.

Because the tag deactivation (and to a lesser extent, detection) requires a relatively large amount of power to be applied to the antenna, the field produced by the applied power could propagate for relatively long distances, and cause interference with other electronic equipment. For this reason, two oppositely phased loops are employed rather than a single loop, because at greater distances, the radiated field contains components from both loops. By utilizing two loops that are driven out of phase, the components produced by the two loops tend to cancel, thereby substantially reducing the distance that the signal from the antenna 10 will propagate.

The active element 12 is driven by a source of radio frequency energy (not shown). In the present embodiment, the radio frequency energy source operates at a frequency of approximately 8 mHz; however, other frequencies can be used by appropriately adjusting the dimensions of the antenna. The energization of the active element 12 by the source of radio frequency electrical energy causes the element 12 to radiate an electromagnetic signal of the same frequency as the frequency at which the element 12 is energized. As is well known, electromagnetic signals propagate efficiently for great distances, and therefore can cause interference with various types of electronic equipment. Even though the loops defined by the conductors 18 and 20 generate electromagnetic fields that are out of phase with each other for the purpose of limiting the propagation distance, due to geometrical and other considerations, complete cancellation does not occur, and the remaining signal may be of sufficient amplitude to cause interference.

To minimize the potential for interference, the shields 14 and 16 serve to minimize the propagation of electric field energy therethrough while permitting magnetic radiation to pass therethrough. Because magnetic radiation does not propagate as efficiently as electromagnetic radiation, the potential for interference is substantially reduced. In designing the shields 14 and 18, it is desirable to provide a large area aperture through the shield to permit the passage of the magnetic field, while providing closely spaced shielding elements to minimize the passage of the electric field. In the illustrated embodiment, the shield 14 is fabricated from a conductive member 40 and a plurality of members 42 extending transversely from the conductive member 40. Similarly, the shield 16 is fabricated from a member 44 and a plurality of transverse members 46. In the illustrated embodiment, the members 40 and 44, as well as the transverse members 42 and 46 are fabricated from a self-supporting wire, in the present embodiment a 24 gauge (approximately 0.020 inch) with the transverse elements 42 and 46 each having spacings of approximately ¼" therebetween. The illustrated antenna is intended to operate at a frequency of approximately 8 mHz, and the element 12 has a horizontal and vertical dimension of approximately 9 inches. The elements 42 and 46 extend slightly beyond the element 12 to assure proper shielding near the edges of the element 12, and in the illustrated embodiment extend approximately ⅜ inch beyond the element 12.

In order further to reduce the electric field radiation from the edges of the active element 12, the edges of the shields 14 and 18 may be formed so that they tend to surround the active element 12. One way this may be accomplished is illustrated in FIG. 3.

In the embodiment illustrated in FIG. 3, components analogous to similar components in FIG. 1 are designated by like reference numerals (in the tens and units digits) preceded by a 1 in the hundreds digits. Thus, an active element 112 (FIG. 3) is analogous to the active element 12 of FIG. 1 and contains a pair of conductive loops that are powered in an out of phase relationship by a pair of conductors 126 and 128. A shield 114, analogous to the shield 14, is comprised of a conductor 140 and a plurality of transverse conductors 142. Similarly, a shield 116, analogous to the shield 16, is formed by a conductor 144 and a plurality of transverse conductors 146. However, the conductors 142 and 146 are curved toward each other to surround the active element 112. A space is provided between the ends of the conductors 142 and 146 to prevent circulating currents from being induced into the shield. Also, the conductors 142 forming the shield 114 may be wrapped almost entirely around as long as they do not touch the active element 112 or the conductors 146. Also, the conductors 146 may be similarly wrapped as long as they do not touch the element 112 or the conductors 142. In each case, the wrapped elements must not reach beyond the feed points 126 and 128 and the ends of the wrapped elements must not contact each other.

Also, in an embodiment utilizing non-planar shields such as those illustrated in FIG. 3, the shields need not be gradually curved toward each other as illustrated in FIG. 3, but may otherwise be turned inwardly. For example, the shields may be simply bent at right angles, or at other angles so that they face each other.

In addition, various matching networks may be employed to supply power to the active element 12 and to provide a source of common potential for the shields 14 and 16. In the embodiment illustrated in FIG. 4, the conductive elements 26 and 28 leading to the active element 12 are powered by a cable 130 analogous to the cable 30 and a network comprising a resistor 136 and a capacitor 138, analogous to the resistor 36 and 38 of FIG. 1, respectively. However, the cable 130 has only a single central conductor 132 having an unbalanced output. This unbalanced output is converted to a balanced output by a toroidal transformer having a toroidal core 50, a grounded primary winding 52 and a center tapped secondary winding 54. The center tap of the winding 54 is grounded and the two ends of the winding 54 drive the active element 12 via the matching network comprising resistor 136 and the capacitor 138. In addition, an adjustable-tap resistor is connected across the winding 54, with the tap of the resistor being connected to the shields of the conductors 40 and 44. Because the variable tap-resistor 56 is connected across the winding 54, and because the winding 54 has a grounded center tap, some point near the center of the resistor 56 will be at ground potential. By appropriately adjusting the tap on the resistor 56 to this point, the shields 14 and 16 may be brought to ground potential. The embodiment illustrated in FIG. 5 is identical to that illustrated in FIG. 4 except that an additional capacitor is connected between the tap and one end of the resistor 56 to provide additional phase correction.

Although the antenna according to the invention has been described as a tag-deactivating antenna for purposes of illustration, it is also usable in other applications wherein it is desired to confine a magnetic field to a relatively small area. Thus the antenna may be used, for example, in the detection of tags at an exit from a protected area. Because of the reciprocal properties of antennas, the antenna according to the invention may be used either as an interrogating antenna for transmitting an interrogating signal into the detection zone, or as a receiving antenna for receiving signals radiated by a tag present in the zone. Because of the confined pattern of the antenna, it is effective as a receiving antenna in an EAS system because it responds to signals radiated by a close object such as a tag, but is effective in rejecting spurious signals generated by distant sources.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A magnetic antenna, comprising:

means including an active element having two loops disposed adjacent each other in a generally coplanar relationship for generating a strong field that has a limited propagation distance near the antenna, said loops being connected together in a parallel connection;

means connected to the parallel connection of said loops for applying signals to said parallel connection to thereby cause currents to flow in opposite directions in said loops; and means including a shield structure having a pair of generally planar shields disposed on opposite sides of said active element in a generally parallel relationship therewith for preventing the passage of the electric field of an electromagnetic radiation therethrough while permitting the passage of magnetic field radiation.

2. A magnetic antenna as recited in claim 1 wherein said shield comprises a structure fabricated from a plurality of individual spaced conductors.

3. A magnetic antenna as recited in claim 1 further including means for connecting the shield to a source of common potential.

4. A magnetic antenna as recited in claim 1 wherein said generally planar shields have portions thereof that extend beyond said loops, and the portions of the generally planar shields that extend beyond the loops are turned to extend toward the loops.

5. A magnetic antenna as recited in claim 1 wherein said loops and said shields are fabricated from a plurality of self-supporting members.

6. An antenna as recited in claim 5 wherein said self-supporting members are spaced approximately $\frac{1}{4}''$ apart.

7. An antenna as recited in claim 6 wherein said shields have horizontal and vertical dimensions of approximately 9 inches for an antenna designated to operate at approximately 8 MHz.

8. A magnetic antenna, comprising:

means including an active element having two single loops disposed adjacent each other in a generally coplanar relationship for generating a strong field that has a limited propagation distance near the antenna, said loops being connected together in a parallel connection;

means connected to the parallel connection of said loops for applying signals to said parallel connection to thereby cause currents to flow in opposite directions in said loops; and means including a shield structure having a pair of generally planar shields disposed on opposite sides of said active element in a generally parallel relationship therewith for preventing the passage of the electric field of an electromagnetic radiation therethrough while permitting the passage of magnetic field radiation.

9. A magnetic antenna, comprising:

means including an active element having two loops disposed adjacent each other in a generally coplanar relationship for generating a strong field that has a limited propagation distance near the antenna, said loops being connected together in a parallel connection at a point generally centrally located on the antenna;

means connected to the parallel connection of said loops for applying signals to said parallel connection to thereby cause currents to flow in opposite directions in said loops; and means including a shield structure having a pair of generally planar shields disposed on opposite sides of said active element in a generally parallel relationship therewith for preventing the passage of the electric field of an electromagnetic radiation therethrough while permitting the passage of magnetic field radiation.

10. A magnetic antenna as recited in claim 9 wherein each of said two loops is a single loop.

* * * * *